US007017738B2

(12) United States Patent
Russo

(10) Patent No.: US 7,017,738 B2
(45) Date of Patent: Mar. 28, 2006

(54) COMPUTER PERIPHERAL PACKAGING ASSEMBLY FOR COMPUTER SYSTEM

(75) Inventor: Christopher Daniel Russo, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 140 days.

(21) Appl. No.: 10/783,618

(22) Filed: Feb. 20, 2004

(65) Prior Publication Data

US 2005/0173275 A1 Aug. 11, 2005

Related U.S. Application Data

(60) Provisional application No. 60/544,146, filed on Feb. 11, 2004.

(51) Int. Cl.
*B65D 85/00* (2006.01)

(52) U.S. Cl. ..... 206/320; 206/232; 229/167

(58) Field of Classification Search ..... 206/320, 206/223, 232, 387.14, 756, 449; 229/117, 229/120.18, 120.21
See application file for complete search history.

(56) References Cited

U.S. PATENT DOCUMENTS

| | | | | |
|---|---|---|---|---|
| 3,368,735 | A * | 2/1968 | Levi | 206/424 |
| 5,284,291 | A * | 2/1994 | Sellors | 229/120.03 |
| D373,723 | S * | 9/1996 | Healey | D9/759 |
| 6,359,777 | B1 * | 3/2002 | Newman et al. | 361/683 |
| 6,491,164 | B1 * | 12/2002 | Virvo | 206/459.5 |
| 6,509,047 | B1 * | 1/2003 | Edomwonyi | 426/107 |
| 6,824,042 | B1 * | 11/2004 | Chu | 229/122.21 |

* cited by examiner

*Primary Examiner*—Shian T. Luong

(74) *Attorney, Agent, or Firm*—John L. Rogitz

(57) ABSTRACT

A computer component packaging assembly can have an essentially two-dimensional flat configuration for storage and a three-dimensional component holding configuration for holding parts such as ac adapters, batteries, and documentation.

23 Claims, 1 Drawing Sheet

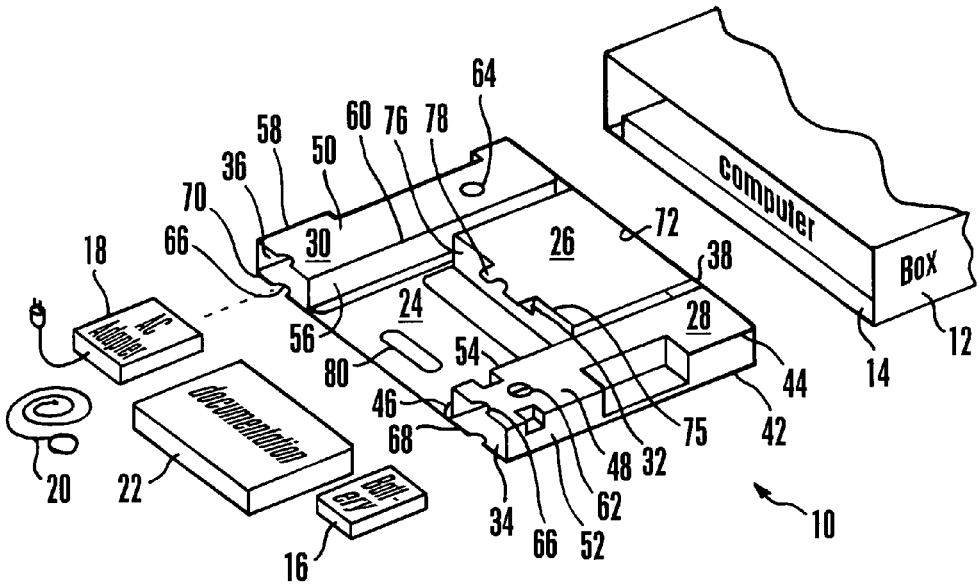
Figure 1
Figure 2
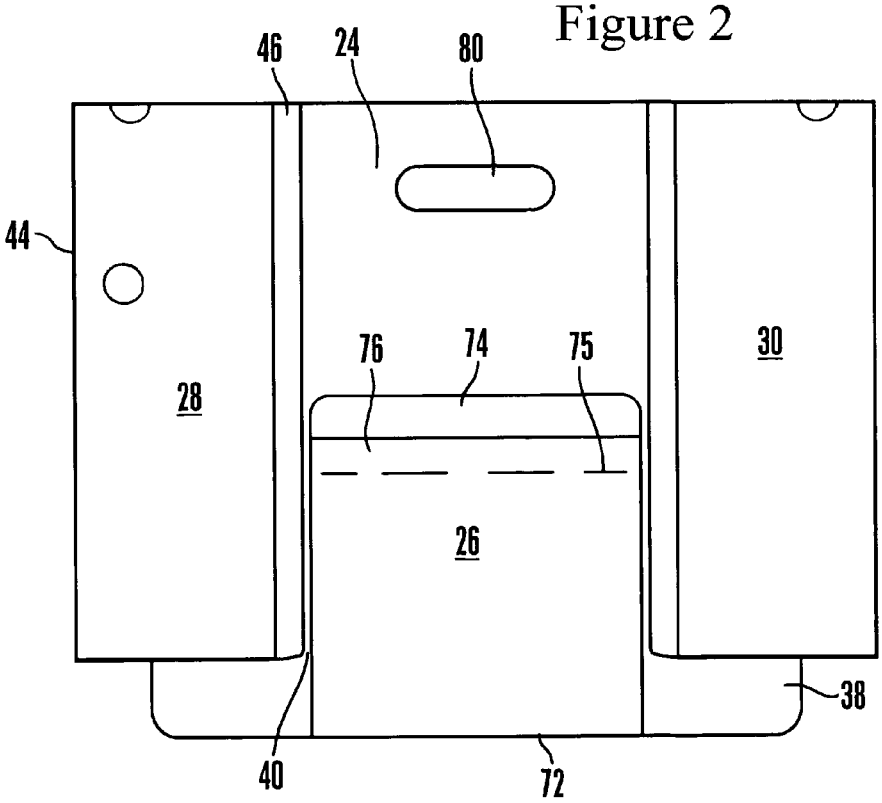

COMPUTER PERIPHERAL PACKAGING ASSEMBLY FOR COMPUTER SYSTEM

RELATED APPLICATIONS

This application claims priority from U.S. provisional application Ser. No. 60/544,146 filed Feb. 11, 2004.

FIELD OF THE INVENTION

The present invention relates generally to shipping containers for computer systems.

BACKGROUND OF THE INVENTION

A computer production area is normally filled with palates of products and shipping cartons for those products. A computer can be shipped to a consumer with many accessories. For example, some computer peripherals include a mouse, a battery charger, a power cord, and a keyboard. These peripherals are not connected to the computer but are still shipped with the computer and generally require separate packaging.

As understood herein, a computer production area can require a great deal of space for manufacturing, testing, and shipping the computer. Also, space is required for loading software onto computers prior to shipment to a consumer. Unfortunately, valuable space is consumed by the shipping materials, which can decrease production throughput. Moreover, once the consumer receives the computer, the computer packaging consumes storage space at the consumer's residence, usually resulting in the consumer discarding the packaging despite the fact that it may be required later for storage or reshipment.

SUMMARY OF THE INVENTION

With the above shortcomings in mind, the present invention can provide at least one piece of corrugated cardboard configured in such a way that it is shipped and stored flat. When it is time to package a computer with accessories, the at least one piece of corrugated cardboard can be formed into a three dimensional shape with inventive features of including, at least in one embodiment, the ability to accommodate multiple accessories, peripherals, and components into a vertically thin form factor. The vertically thin form factor allows for top loading of the computer peripherals into the container for quick packaging assembly.

In another embodiment, the present packaging may not revert to a flat shape when a user removes computer equipment packaging (cushioning) material, but the packaging will revert to a flat shape once the consumer removes the peripherals themselves. The packaging may also include a handle that makes removal and transport easy.

In one non-limiting aspect, a computer peripheral packaging assembly for holding portions of a computer system includes a flat bottom panel and at least one accessory support movable between a storage configuration, wherein the accessory support is substantially flat against the bottom panel, and a component holding configuration, wherein the accessory support defines at least in part a parallelepiped shaped enclosure. Also, a documentation support is movable between a storage configuration, wherein the documentation support is substantially flat against the bottom panel, and a component holding configuration, wherein the documentation support defines at least in part a parallelepiped shaped enclosure that is wider and shorter than the enclosure defined by the accessory support in the component holding configuration.

In another non-limiting aspect, a computer peripheral packaging assembly for holding portions of a computer system can include a bottom panel and at least two supports that share a common wall in a component holding configuration.

In yet another non-limiting aspect, a computer peripheral packaging assembly for holding portions of a computer system can include a bottom panel and at least two supports, with at least half of the area of each support overlapping the area of the bottom panel in a storage configuration.

In preferred non-limiting embodiments, two identical accessory supports can be provided with the documentation support being intermediate the accessory supports. The accessory support and documentation support may cooperate with the bottom panel to define the respective enclosures. An ac adapter and/or a computer battery can be inside the accessory support, while the documentation support may be configured for supporting at least one paper document.

If desired, the accessory support can be formed with a top wall that is spaced from the bottom panel in the component holding configuration, with at least one hole being formed through the top wall. Also, the accessory support may include opposed side walls hingedly engaged with the bottom panel. Slits can be formed in the accessory support between the top wall and the side walls. The accessory support can be formed with a semicircular notch at an end of the top wall. On the other hand, the documentation support can include a top wall spaced from the bottom panel in the component holding configuration and attached thereto by front and rear walls hingedly engaged with the bottom panel. The top wall of the documentation support may be formed with a tab extending outwardly from an edge of the top wall, and the rear wall may extend laterally beyond the enclosure defined by the documentation support to establish a rear wall of the accessory support.

The details of the present invention, both as to its structure and operation, can best be understood in reference to the accompanying drawings, in which like reference numerals refer to like parts, and in which:

BRIEF DESCRIPTION OF THE DRAWINGS

FIG. 1 is a perspective view of the computer component packaging assembly in the component holding configuration, showing components to be packaged in an exploded relationship with the packaging; and FIG. 2 is a top view of the computer component packaging assembly in the storage configuration.

DETAILED DESCRIPTION OF THE PREFERRED EMBODIMENT

Referring initially to FIG. 1, a packaging assembly is shown, generally designated 10, for holding, in a box 12 that can contain a computer 14, various components of a computer system, including a computer battery 16, an ac adapter 18, an electrical connector cord 20, and various paper documentation 22 in accordance with further discussion below. In accordance with present principles, the packaging assembly 10 may be made of a single piece of cardboard that can be made to assume a storage configuration (FIG. 2), wherein the various below-described supports of the packaging assembly 10 are substantially flat against a bottom panel 24 of the assembly 10, and a component holding configuration, wherein the supports define three dimensional enclosures.

For illustration purposes terms of orientation (such as "front", "bottom", etc.) will be used in the discussion below, it being understood that the terms of orientation are relative only and non-limiting. For instance, the "front" of the packaging assembly 10 may actually be placed against what might be termed a "rear" wall of the box 12, etc.

FIGS. 1 and 2 show that the assembly 10 includes a documentation support 26 and preferably two accessory supports 28, 30 that flank the documentation support 26. All three supports 26–30 are movable between the storage configuration shown in FIG. 2, wherein the supports 26–30 are substantially flat against the bottom panel 24, and the component holding configuration shown in FIG. 1, wherein the supports 26–30 define respective parallelepiped shaped enclosures 32, 34, 36. In the embodiment shown in FIG. 1, the enclosure 32 defined by the documentation support 26 is wider and shorter than the enclosures 34, 36 defined by the accessory supports 28, 30. The enclosures 32–36 are bounded on their bottoms by the bottom panel 24.

When in the storage configuration shown in FIG. 2, over half of the areas of the accessory supports 28, 30 overlap the area of the bottom panel 24, thereby reducing the "footprint" of the packaging assembly 10. Also, in the storage configuration the documentation support 26 is flat against the bottom panel 24 and a back wall panel 38 that is integral to an coplanar with the bottom panel 24, further reducing the footprint of the assembly 10. A score line 40 extends between the back wall panel 38 and bottom panel 24 so that the back wall panel 38 can be folded about the score line 40 to assume a perpendicular orientation with respect to the bottom panel 24 in the component holding configuration. Also, the back wall panel 38 extends laterally beyond the accessory supports 28, 30 as shown in FIGS. 1 and 2 so that it can form a common continuous back wall for all three supports 26, 28, 30 in the component holding configuration.

In cross-reference to the figures, the bottom left edge 42 of the left-most accessory support 28 is integral to the bottom panel 24, while the top left edge 44 of the left-most accessory support 28 is directly above the bottom left edge 42 in the component holding configuration (FIG. 1) and directly laterally left of the bottom left edge 42 in the storage configuration (FIG. 2). An inner holding tab 46 of the left-most accessory support 28 is glued to the bottom panel 24. The right-most accessory support 30 is similarly configured. With this structure, the accessory supports 28, 30 can be moved from the flat storage configuration to the parallelepiped-shaped component holding configuration by pushing the outer edges of the supports 28, 30 toward the middle of the assembly 10. This is because the bottom edges and holding tabs of the supports 28, 30 are affixed to the bottom panel 24, whereas the top surfaces 48, 50 of the accessory supports 28, 30 are connected to the bottom panel by side walls 52, 54, 56, 58 of the accessory supports 28, 30, and score lines that may include slits 60 extend between the top surfaces 48, 50 and respective side walls 52–58 of the accessory supports 28, 30 to facilitate hinged motion between the top surfaces and side walls when moving between the configurations shown in FIGS. 1 and 2. It will be appreciated that the side walls 52–58 are also hinged to the bottom panel 24. If desired, each accessory support 28, 30 may include a respective circular cut-out 62, 64 in its top surface 48, 50, as well as semicircular notches 66 in both the top and bottom front edges 68, 70 of the supports 28, 30.

With respect to the documentation support 26, its top rear edge 72 is integral with and hinged to the rear wall panel 38. Also, a front holding tab 74 of the documentation support 26 extends parallel to the back wall panel 38 and is glued to the bottom panel 24. A score line 75 can extend across the support 26 parallel to and spaced rearwardly of the front holding tab 74 to define what will become a front wall 76 therebetween. It will be appreciated in cross-reference to FIGS. 1 and 2 that the documentation support 26 can be moved from the flat configuration to the component holding configuration by pushing the rear edge 72 forward, causing the rear edge 72 to hinge about the back wall panel 38 and the back wall panel 38 to hinge about the score line 40. Also, hinged motion occurs between the front wall 76 and score line 75 and between the front wall 76 and front holding tab 74 such that the front wall 76 assumes the vertical orientation shown in FIG. 1.

In the component holding configuration, the sides of the enclosure 32 defined by the documentation support 26 are open, the rear is enclosed by the rear wall panel 38, and the front is enclosed by the front wall 76 except for an opening that is created when a tab 78 that is formed in the front wall 76 is pushed up to be coplanar with the top wall of the documentation support 26. It may now be appreciated that the documentation 22 may be slid under the tab 78 and retained on its sides by the accessory supports 28, 30, such that the documentation support is configured for supporting paper documents. Also, in the configuration shown in FIG. 1 the rear wall panel 38 extends across the backs of the accessory supports 28, 30 to enclose the rear of the respective enclosures 36, 38, with the fronts of the enclosures 36, 38 remaining open as shown. A racetrack-shaped cut-out 80 can be formed in the bottom panel 24 to establish a handle, if desired.

With the above structure in mind, one or more accessories (e.g., the ac adapter 18 and cord 20) can be disposed in the enclosure 36 of the right-most accessory support 30, and one or more other components (e.g., the battery 16) can be disposed in the enclosure 34 of the left-most accessory support 28. Also, the documentation 22 can be held in the assembly 10 as described. The assembly 10 with components and documentation may then be placed in the box 12 next to, e.g., the computer 14 for shipment. Upon receipt by a customer, the components can be removed from the packaging assembly 10 and the assembly 10 folded back down to the storage configuration of FIG. 2 for space-saving storage if desired.

While the particular COMPUTER PERIPHERAL PACKAGING ASSEMBLY FOR COMPUTER SYSTEM as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". It is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. Absent express definitions herein, claim terms are to be given all ordinary and accustomed meanings that are not irreconcilable with the present specification and file history.

What is claimed is:

1. A computer peripheral packaging assembly for at least portions of a computer system, comprising:

a flat bottom panel;

at least one accessory support movable between a storage configuration, wherein the accessory support is substantially flat against the bottom panel, and a component holding configuration, wherein the accessory support defines at least part of a parallelepiped shaped enclosure; and at least one documentation support movable between a storage configuration, wherein the documentation support is substantially flat against the bottom panel, and a component holding configuration, wherein the documentation support defines at least part of a parallelepiped shaped enclosure wider and shorter than the at least part of the enclosure defined by the accessory support in the component holding configuration, wherein the accessory support is a first accessory support and the assembly also includes a second accessory support substantially identical to the first accessory support, the documentation support intermediate the first and second accessory supports.

2. The computer peripheral packaging assembly of claim 1, wherein the accessory support and documentation support cooperate with the bottom panel to define the respective enclosures.

3. The computer peripheral packaging assembly of claim 2, comprising at least one of: an ac adapter, and a computer battery, inside the accessory support.

4. The computer peripheral packaging assembly of claim 1, wherein the documentation support is configured for supporting at least one paper document.

5. The computer peripheral packaging assembly of claim 1, wherein the accessory support is formed with at least one top wall spaced from the bottom panel in the component holding configuration, at least one hole being formed through the top wall.

6. The computer peripheral packaging assembly of claim 5, wherein the accessory supper includes opposed side walls hingedly engaged with the bottom panel, slits being formed in the accessory support between the top wall and the side walls.

7. A computer peripheral packaging assembly for at least portions of a computer system, comprising:

a flat bottom panel:

at least one accessory support movable between a storage configuration, wherein the accessory support is substantially flat against the bottom panel, and a component holding configuration, wherein the accessory support defines at least part of a parallelepiped shaped enclosure; and at least one documentation support movable between a storage configuration, wherein the documentation support is substantially flat against the bottom panel, and a component holding configuration, wherein the documentation support defines at least part of a parallelepiped shaped enclosure wider and shorter than the at least part of the enclosure defined by the accessory support in the component holding configuration, wherein the accessory support is formed with at least one top wall spaced from the bottom panel in the component holding configuration, at least one hole being formed through the top wall, and further wherein the accessory support is formed with a semicircular notch at an end of the top wall.

8. A computer peripheral packaging assembly for at least portions of a computer system, comprising:

a flat bottom panel;

at least one accessory support movable between a storage configuration, wherein the accessory support is substantially flat against the bottom panel and a component holding configuration, wherein the accessory support defines at least part of a parallelepiped shaped enclosure; and at least one documentation support movable between a storage configuration, wherein the documentation support is substantially flat against the bottom panel, and a component holding configuration, wherein the documentation support defines at least part of a parallelepiped shaped enclosure wider and shorter than the at least part of the enclosure defined by the accessory support in the component holding configuration, wherein the documentation support includes a top wall spaced from the bottom panel in the component holding configuration and attached thereto by front and rear walls hingedly engaged with the bottom panel.

9. The computer peripheral packaging assembly of claim 8, wherein the top wall of the documentation support is formed with a tab extending outwardly from an edge of the top wall.

10. The computer peripheral packaging assembly of claim 8, wherein the rear wall extends laterally beyond the enclosure defined by the documentation support to establish a rear wall of the accessory support.

11. A computer peripheral packaging assembly for at least portions of a computer system, comprising:

a flat bottom panel;

at least one accessory support movable between a storage configuration, wherein the accessory support is substantially flat against the bottom panel, and a component holding configuration, wherein the accessory support defines at least in part a first enclosure; and at least one documentation support movable between a storage configuration, wherein the documentation support is substantially flat against the bottom panel, and a component holding configuration, wherein the documentation support defines at least in part a second enclosure, the supports sharing a common wall in the component holding configuration, wherein the documentation support includes a top wall spaced from the bottom panel in the component holding configuration and attached thereto by front and rear walls hingedly engaged with the bottom panel.

12. The assembly of claim 11, wherein the second enclosure is wider and shorter than the enclosure defined by the accessory support in the component holding configuration.

13. The computer peripheral packaging assembly of claim 11, wherein the accessory support and documentation support cooperate with the bottom panel to define the respective enclosures.

14. The computer peripheral packaging assembly of claim 11, wherein the accessory support is formed with at least one top wall spaced from the bottom panel in the component holding configuration, at least one hole being formed through the top wall.

15. The computer peripheral packaging assembly of claim 14, wherein the accessory support includes opposed side walls hingedly engaged with the bottom panel, slits being formed in the accessory support between the top wall and the side walls.

16. The computer peripheral packaging assembly of claim 11, wherein the top wall of the documentation support is formed with a tab extending outwardly from an edge of the top wall.

17. A computer peripheral packaging assembly for at least portions of a computer system, comprising:

a flat bottom panel;

at least one accessory support movable between a storage configuration, wherein the accessory support is substantially flat against the bottom panel, and a component holding configuration, wherein the accessory support defines at least in part a first enclosure; and at least one documentation support movable between a storage configuration, wherein the documentation support is substantially flat against the bottom panel, and a component holding configuration, wherein the documentation support defines at least in part a second enclosure, the supports sharing a common wall in the component holding configuration, wherein the accessory support is a first accessory support and the assembly also includes a second accessory support substantially identical to the first accessory support, the documentation support being intermediate the first and second accessory supports.

18. A computer peripheral packaging assembly for at least portions of a computer system comprising:

a flat bottom panel;

at least one accessory support movable between a storage configuration, wherein the accessory support is substantially flat against the bottom panel, and a component holding configuration, wherein the accessory support defines at least in part a first enclosure; and at least one documentation support movable between a storage configuration, wherein the documentation support is substantially flat against the bottom panel, and a component holding configuration, wherein the documentation support defines at least in part a second enclosure, the supports sharing a common wall in the component holding configuration, wherein the accessory support is formed with at least one top wall spaced from the bottom panel in the component holding configuration, at least one hole being firmed through the top wall and further wherein the accessory support is formed with a semicircular notch at an end of the top wall.

19. A computer peripheral packaging assembly for at least portions of a computer system, comprising:

a flat bottom panel defining an area and being integral with a back wall panel;

at least one accessory support movable between a storage configuration, wherein the accessory support is substantially flat against the bottom panel, and a component holding configuration, wherein the accessory support defines at least in part a first enclosure, the accessory support defining an area in the storage configuration, at least half of the area of the accessory support overlapping the area of the bottom panel in the storage configuration; and at least one documentation support movable between a storage configuration, wherein the documentation support is substantially flat against the bottom panel, and a component holding configuration, wherein the documentation support defines at least in part a second enclosure, the documentation support being flat against the bottom panel and back wall panel in the storage configuration, the bottom panel being coplanar with the back wall portion in the storage configuration, wherein top wall of the documentation support is formed with a tab extending outwardly from an edge of the top wall.

20. The assembly of claim 19, wherein the second enclosure is wider and shorter than the enclosure defined by the accessory support in the component holding configuration.

21. The computer peripheral packaging assembly of claim 19, wherein the accessory support is formed with at least one top wall spaced from the bottom panel in the component holding configuration, at least one hole being formed through the up wall.

22. The computer peripheral packaging assembly of claim 21, wherein the accessory support includes opposed side walls hingedly engaged with the bottom panel, slits being formed in the accessory support between the top wall and the side walls.

23. A computer peripheral packaging assembly for at least portions of a computer system, comprising:

a flat bottom panel defining an area and being integral with a back wall panel;

at least a first accessory support movable between a storage configuration, wherein the first accessory support is substantially flat against the bottom panel, and a component holding configuration, wherein the first accessory support defines at least in part a first enclosure, the first accessory support defining an area in the storage configuration, at least half of the area of the first accessory support overlapping the area of the bottom panel in the storage configuration;

at least one documentation support movable between a storage configuration, wherein the documentation support is substantially flat against the bottom panel, and a component holding configuration, wherein the documentation support defines at least in part a second enclosure, the documentation support being flat against the bottom panel and back wall panel in the storage configuration, the bottom panel being coplanar with the back wall portion in the storage configuration; and a second accessory supports substantial identical to the first accessory support, the documentation support being intermediate the first and second accessory supports.

* * * * *